US005337661A

United States Patent [19]

Goldberg

[11] Patent Number: 5,337,661

[45] Date of Patent: Aug. 16, 1994

[54] THERMAL POSTAGE METER DRIVE SYSTEM

[75] Inventor: Stephen F. Goldberg, Dayton, Ohio

[73] Assignee: Pitney Bowes Inc., Stamford, Conn.

[21] Appl. No.: 55,588

[22] Filed: May 3, 1993

[51] Int. Cl.[5] ..... B41L 47/46; B41J 23/34

[52] U.S. Cl. ..... 101/91; 400/120.16; 400/185; 400/649

[58] Field of Search ..... 400/185, 187, 568, 569, 400/649, 120, 570, 650, 652; 101/91, 93, 76; 346/76 PH

[56] References Cited

U.S. PATENT DOCUMENTS

| | | | |
|---|---|---|---|
| 4,679,953 | 7/1987 | Sone et al. | 400/120 X |
| 4,705,413 | 11/1987 | Arnoldi et al. | 101/91 X |
| 4,747,707 | 5/1988 | Komori | 400/185 X |
| 4,759,283 | 7/1988 | Gilham et al. | 101/91 |
| 4,763,575 | 8/1988 | Miciukiewicz | 101/91 |
| 4,938,129 | 7/1990 | Miciukiewicz et al. | 101/76 |
| 5,215,392 | 6/1993 | Tobita et al. | 400/649 X |

*Primary Examiner*—Edgar S. Burr
*Assistant Examiner*—Christopher A. Bennett
*Attorney, Agent, or Firm*—Charles G. Parks, Jr.; Melvin J. Scolnick

[57] ABSTRACT

The thermal printing postage meter includes a base supporting a registration wall and a deck, a micro controller and a thermal tape cassette detachably mounted to the registration wall. A position assembly is provided for causing a platen roller to assume a print position or a non-print position and for causing the ejection roller to assume an engaged or disengaged position. A single motor is under the control a micro controller. A linkage system is provided which communicates with the motor and a take-up spool. The linkage system sequentially causes the position assembly to position the platen roller in the print position, position the ejection roller in the disengaged position and communicating with the take-up spool when the motor is rotated in a first direction by the micro controller, rotatively drives the platen and rotatively driving the take-up spool when the rotation of the motor is now driven in a reverse direction by the micro controller, causing the first position means to position the platen roller in the non-print position, position the ejection roller in the engaged position and terminating communication with the take-up spool when the motor is again rotated to its first direction by the micro controller, and rotatively driving the ejection rollers when the rotation of the motor is now again driven in the reverse direction by the micro controller.

5 Claims, 6 Drawing Sheets

THERMAL POSTAGE METER DRIVE SYSTEM

BACKGROUND OF THE INVENTION

The present invention relates to the drive system for a thermal printing apparatus and, more particularly, to the drive system of a thermal printing postage meter.

A thermal printing postage meter system, of the type more particularly described in U.S. patent application Ser. No. 07/950,341 (Attorney Docket C-912), is composed of a number of system modules. Generally, upon the placement of an envelope on the deck of the thermal printer by an operator, the envelope is caused to encounter a position sensing assembly that includes an envelope stop arrangement. The envelope stop arrangement prevents the envelope from being longitudinally mis-positioned. Upon proper positioning of the envelope on the deck, the position sensing assembly senses the presence of the envelope and informs a micro controller to first duck the positioning sensing assembly out of the way, inclusive of a stop assembly, by actuating a first motor and initiate the print sequence. The first motor and its associated drive assembly are also responsible for repositioning the platen roller to bias the print area of the envelope into contact with the print ribbon of a ribbon cassette. During the print cycle, the micro controller issues a command to cause a second motor in combination with its associated drive assembly to then drive the platen roller. Rotation of the platen roller causes the envelope and cassette print ribbon to simultaneously traverse the print head while the micro controller concurrently enables the thermal print head. A third motor under the control of the micro controller is provided which acting through the associated drive assembly acts on the take-up spool of the thermal cassette to assure that the thermal ribbon remains tight during the printing process. Following completion of the print cycle, the micro controller causes the first motor and its associated drive assembly to duck the platen roller below the deck and engages the pressure roller for ejection of the envelope by the second motor and its associated drive assembly. The ribbon takeup motor stops. This allows the envelope to advance while the ribbon remains stationary, thus not using ribbon in non-print areas.

It is really appreciated, that the presence of three motors represents a substantial cost consequence to the thermal print system. It shall be further appreciated that the cost consequence is compounded since the thermal printing system must be precisely controlled and, thereby, requiring a precise motor control system and associated motors.

SUMMARY OF THE INVENTION

It is an objective of the present invention to present a drive system for a thermal printing apparatus of the type described including fewer motors to offer improved cost efficiencies.

It is a further objective of the present invention to present an improved drive system particularly suited for a thermal printing postage meter of the type described including fewer motors.

A known type of thermal postage meter is comprised of a plurality of system modules. Upon the placement of an envelope on the deck of the thermal printer by an operator, the envelope is caused to encounter a position sensing assembly which includes an envelope stop assembly which assemblies are responsive to a first shaft. Upon proper positioning of the envelope on the deck, the position sensing assembly senses the presence of the envelope and informs a micro controller to first duck the positioning sensing assembly out of the way, inclusive of the stop assembly, and initiate the print sequence. Upon initiation of the print sequence, a platen roller assembly is repositioned to bias the print area of the envelope into contact with the print ribbon of a ribbon cassette further in response to the first shaft. The thermal print head of the postage meter is positioned to also serve as a backing to the print ribbon. Rotation of the platen roller in response to a second shaft causes the envelope and cassette print ribbon to simultaneously traverse the print head while the micro controller concurrently enables the thermal print head. Cassette print ribbon take-up tension is maintained in response to rotation of a third shaft. Following completion of the print cycle, the micro controller causes the platen roller to be ducked in response to the further rotation of the first shaft below the deck concurrently positioning pressure rollers. In response to rotation of the second shaft, the pressure rollers eject the envelope from the mailing machine.

A drive motor under the influence of the micro controller is provided. The output of the drive motor is directed to a main drive shaft having a first and second one-way clutch pulley. The pulleys are mounted to the drive shaft. When the motor is actuated in a first rotational direction, power is delivered to the first shaft through the first pulley and endless belt. When the motor is actuated in a second rotational direction, power is delivered to the second shaft through the second pulley and an endless belt. The second shaft further includes a pulley which through a positionable lever communicates driving rotational force to the third shaft.

DETAILED DESCRIPTION OF THE PREFERRED EMBODIMENT

Figure 1:
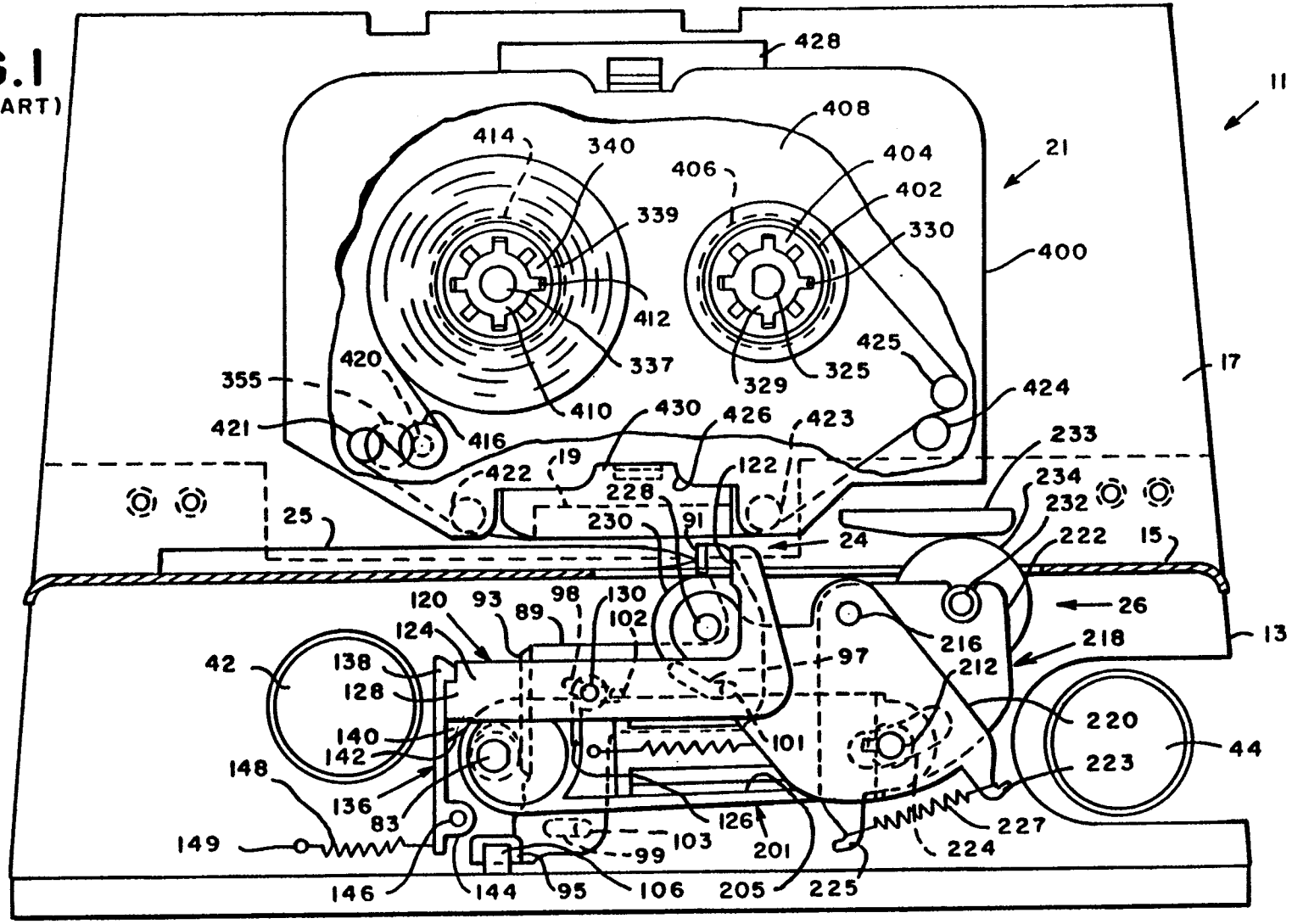
FIG. 1 (PRIOR ART)
FIG. 1 is a partly section frontal view of a known thermal postage meter and ribbon cassette.

Referring to FIG. 1, a known thermal postage meter, generally indicated as 11 and more particularly described in U.S. patent application Ser. No. 07/950,341, entitled Thermal Printing Postage Meter System, commonly assigned and herein incorporated by reference, includes a base 13 which supports a deck 15. The base 13 supports a registration wall 17, by any conventional means, to extend vertically upward from the deck. A thermal print head 19 is fixably mounted, by any conventional means, to the registration wall 17. The registration wall 17 has mounted thereto a thermal ribbon cassette 21. Mounted in the base 13 is a position sensing arrangement, generally indicated as 24, for sensing the position of an envelope 25 positioned on the deck 15 such that a leading portion of the envelope 25 is aligned to a platen roller assembly, generally indicated as 26.

Figure 5:
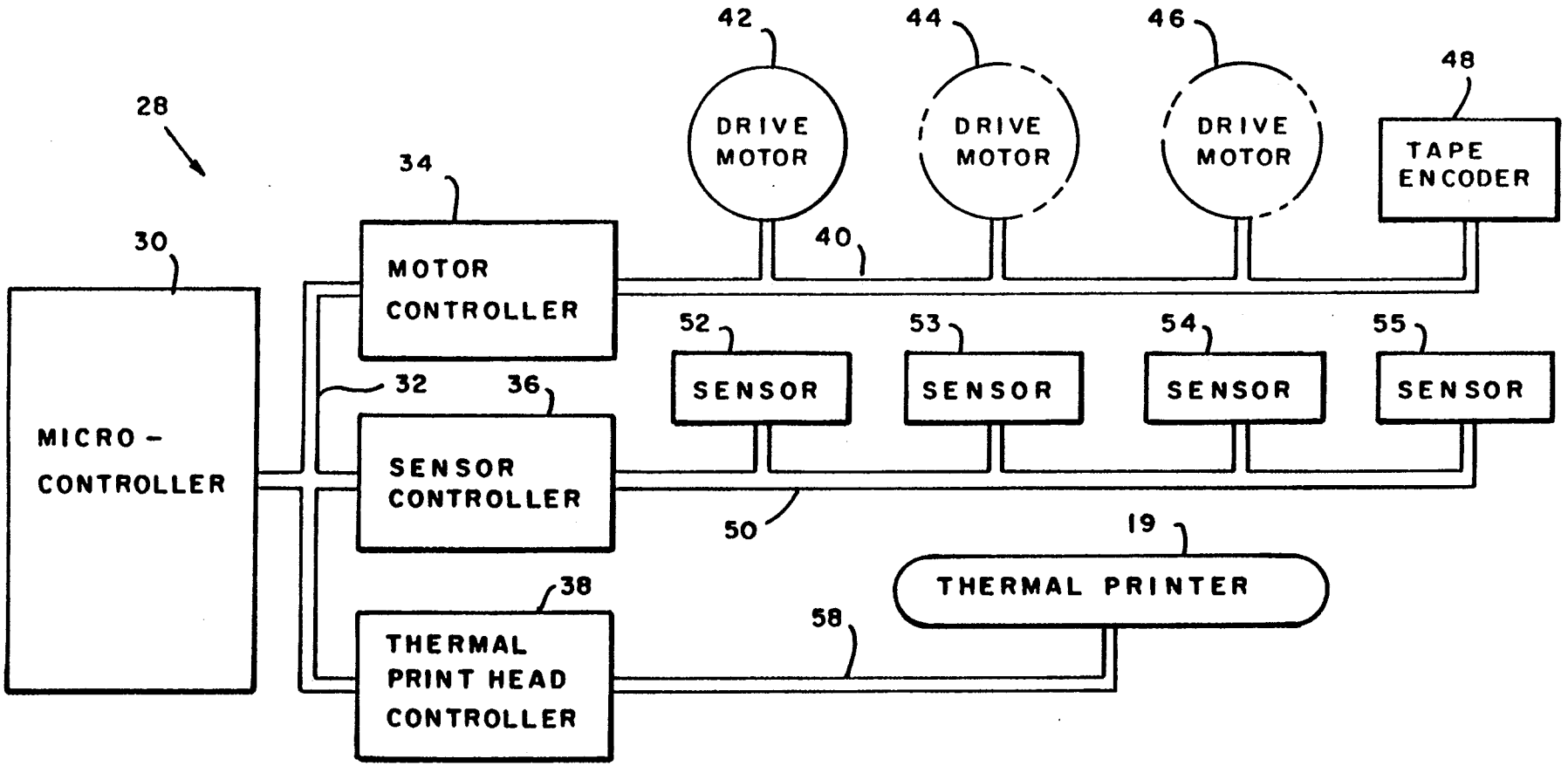
FIG. 5 is a schematic of a suitable micro controller in accordance with the present invention.

Referring to FIG. 5, the thermal printing meter is under the influence of a system micro controller, generally indicated as 28. The micro controller system 28 is comprised of a programmable micro controller 30 of any suitable conventional design, which is in bus 32 communication with a suitable motor controller 34, sensor controller 36, and thermal print head controller 38. The motor controller 34, sensor controller 36 and thermal print head controller 38 may be of any suitable conventional design. The motor controller 34 is in motor bus 40 communication with a plurality of drive motors 42, 44 and 46. The motor control bus 40 also communicates the motor controller 34 to a tape encoder 48. The sensor controller 36 is in sensor bus 50 communication with a plurality of sensors 52 to 55 and the thermal printer controller 38 is in print head bus 58 communication with the thermal print head 19. It should be appreciated that the system micro controller 28 is suitable of the present invention.

A shaft 83 is rotatively mounted to extend between the bracket walls 77 and 79 by any conventional means such as by a bearing assembly. A drive gear 85 is fixably mounted to the shaft 83 at one end. A motor 42 has an output gear 87 which is in constant mesh with the drive gear 85 for causing the shaft 83 to rotate under the influence of the motor 42. A position lever 89 which includes a envelope facing surface 91, camming surface 93, and sensor tab 95, and further includes slots 97, 98 and 99, is slidably mounted on hubs 101, 102 and 103 formed on the rear wall 79 of the bracket 75. The position lever 89 is mounted to the rear wall 79 such that the hubs 101, 102 and 103 ride within the respective slots 97, 98 and 99. A cam 105 is eccentrically mounted to the shaft 83 such that the camming periphery of the cam 105 is opposite the camming surface 93 of the position lever 89. A spring 107 is detachably mounted to the position lever at one end and to a formed tab 109 in the rear wall 79 at the other end. The spring biases the position lever 89 such that the camming surface 93 is biased against the cam surface of cam 105.

Mounted to the forward bracket wall 77 is an envelope stop lever 120 which includes an envelope facing surface 122, channeled main section 124, a collared tab 126 mounted within the channel section 124, a cam follower surface 127 and an interlock tab 128. The stop lever 120 is pivotally mounted on a hub 130 which is formed in the forward bracket wall 77. A spring 132 which has one end attachably mounted to a tab 134 formed on the rearward bracket wall 77 and the other end attachably mounted to the collared tab 126 biases the camming surface 127 against the cam 105. A locking lever 136 is provided which includes a locking tab 138 and 140 for securing the locking tab 128 to the envelope stop lever 120 between the locking tabs 138 and 140 of the locking lever 136. The locking lever 136 also includes a camming surface 142 opposite the cam 105 and a formed support ring 144 which is pivotally mounted to a tab 146 formed in the forward bracket wall 77. A spring 148 which is detachably mounted at one end to a tab 149 and at its other end to the envelope locking lever 136 is mounted for biasing the locking lever 136 in the direction of the cam 127.

The platen roller assembly 26 includes a linking arm assembly 201 comprising a first link section 203 having a receiving channel 205 and a second section 207 having a portion matingly received in the receiving channel 205 of the first linking section 203. One end of the first linking section 208 is eccentrically mounted around the shaft 83 on eccentric rockers 209. A spring 210 having its respective end detachably mounted in the first and second sections of the linking arm 203 and 207, respectively, biases the second section 207 within the receiving channel 205 of the first link section 203. The exposed end of the second section 207 includes a hub 212. A second linking arm assembly 214 is constructed identical to the linking assembly 201 and is eccentrically mounted in cooperative alignment with the linking arm assembly 201 on the shaft 83.

A pivot link assembly, generally indicated as 218, is mounted to a shaft 216 which is rotatively mounted between the rearward and forward bracket walls 77 and 79, respectively. The pivot link assembly 218 includes a first link plate 220 pivotally mounted around shaft 216 at one point and pivotally mounted around the hub 212 at another point. A second link plate 222 is pivotally mounted around the shaft 216 at one point and includes a slot 224 wherein the hub 212 rides therein. A spring hook 223 is formed in the first link plate 220 and a spring hook 225 is formed in the second link plate 222. A spring 227 has its respective ends fastened around the respective spring hooks 223 and 225 in a conventional manner. A second pivot link assembly 226, identical to the pivot link assembly 218, is pivotally mounted to the shaft 216 in spaced apart relationship to the pivot link assembly 218. A platen module 228 is rotatively mounted by any conventional means to the link plates 220 of the respective pivot link assemblies, 218 and 226. A platen roller 230 is fixably mounted around the platen roller shaft 228, between the pivot link assemblies, 218 and 226.

A pressure roller shaft 232 is rotatively mounted by any conventional means to the link plates 222 of the respective pivot link assemblies 218 and 226. Pressure rollers 234 are fixably mounted around the pressure roller shaft 232 in spaced apart relationship. The pressure roller 234 is aligned generally opposite a backing member fixably mounted on the registration wall 17 and extending laterally therefrom. A drive shaft 236 having a spool 238 fixably mounted to one end is responsive to the motor 44. A spool gear arrangement 240 which includes a hub 242 rotatively mounted around the shaft 216. A spool 244 is fixably mounted to the hub 242. A gear 246 is fixably mounted to shaft 216. A gear 248 is fixably mounted to the shaft 232 and a gear 250 is fixably mounted around the shaft 228. The gear 246 is in constant mesh with gears 248 and 250, and an endless belt 252 extends around the spools 238 and 244.

A mounting platform 301 is fixably mounted, by any conventional means, to the back side of the registration wall 17. A tape motor 46 is fixably mounted to the mounting platform 301, by any suitable conventional means. The output shaft 303 of the drive motor 46 has a drive gear 305 fixably mounted to the output shaft 303 of the drive motor 46. A conventional double gear set 307 having a first gear 309 in constant mesh with the drive gear 305 and a second gear 311 rotatively mounted to the back side of the registration wall 17. A conventional double idle gear set 313 having first gear 315 in constant mesh with the gear 311 and a second gear 317 is rotatively mounted by any conventional means to a gear hub 319. The gear hub 319 is fixably mounted to the mounting platform by any conventional means and rotatively supports the idle gear set 313 by any suitable conventional means. A registration wall aperture 321 is formed in the registration wall 17. A conventional bearing hub assembly 323 is fixably mounted to the back side of the registration wall 17 aligned to the aperture 321. A tape drive shaft 325 extends through the aperture 321 rotatively supported by the bearing hub assembly 323. A gear 327 is fixably mounted by any conventional means to one end of the tape drive shaft 325 in constant mesh with the gear 317. A tape drive spool 329 is fixably mounted by any conventional means around a portion of the tape drive shaft 325.

A tape idle assembly, generally indicated as 331, is mounted to the back side of the registration wall 17 aligned to a registration wall aperture 333. The tape idle assembly 331 includes a conventional one way clutch and shaft assembly 335 of any suitable construction fixably mounted to the back side of the registration wall 17 aligned to the aperture 333. The assembly 335 includes an idle shaft 337 extending through the aperture 333. A tape idle spool 339 is fixably mounted by any conventional means around a portion of the idle shaft 337.

An encoding assembly, generally indicated as 341, is fixably mounted to a mounting spindle 343 which is fixably mounted to the back side of the registration wall 17, by any suitable conventional means, aligned to a registration wall aperture 345. The encoding assembly 341 includes collar 347 and an input shaft 349. A mating male shaft 351 is received by the shaft 349 such that the male shaft 351 can experience limited axially displacement within the shaft 349 and such that the male shaft rotatively drives the shaft 349 such as by any suitable conventional mating longitudinal gears arrangement. A spring 353 is placed around the shaft 351 and an end cap gear 355 is fixably mounted by any conventional means to the shaft 351 within the aperture 345.

The tape cassette 21 is comprised of a cassette housing 400 having a drive spool 402. The drive spool has formed axial extending gear teeth 404. The drive spool 402 is rotatively mounted by suitable conventional means in the cassette housing 400 to be axially aligned to an opening 406 in the rear wall 408 of the housing 400. The gear teeth 404 of the drive spool 402 are configured to be mating to axial gear teeth 330 formed on the periphery of the tape drive spool 329. In like manner to drive spool 402, the cassette housing includes idle spool 339 having axial extending gear teeth 340 rotatively mounted to the rear wall 408 aligned to an opening 414 in the rear wall 408. The gear teeth 412 are configured to be mating to axial gear teeth 412 formed on the periphery of the tape idle spool 410. An encoding roller 416 is rotatively mounted in the cassette rear wall 408, by any suitable conventional means, having a short shaft 418 extending through the rear wall 408 and into the aperture 345 in the registration wall 17. A gear 420 is fixably mounted to one end of the short shaft 418 to be in constant mesh with the gear 355 of the encoding assembly 341. A plurality of drag posts 421, 422, 423, 424 and 425 are strategically mounted fixably by any conventional means to the cassette rear wall 408. The cassette housing 400 further has a cassette opening 426 and is mounted between upper clamp 428 and lower clamp 430 which extend from the registration wall 17.

Figure 4:
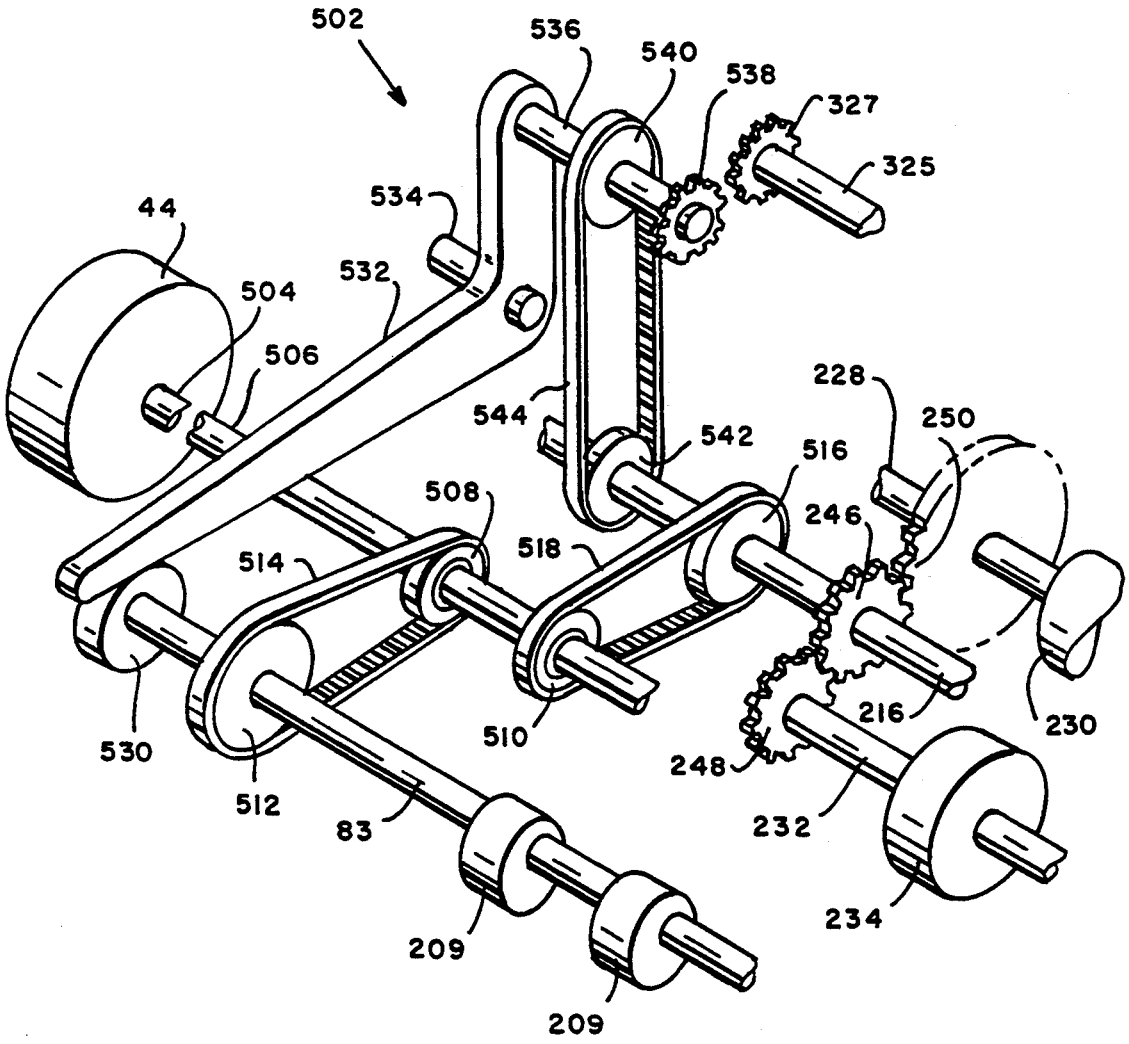
FIG. 4 is a prospective view of a drive system in accordance with the present invention and particularly suited for driving the known thermal postage meter.

Referring now to FIG. 4, the present invention is intended to provide the required drive action as above described for the known thermal postage meter utilizing a single motor 44 and associated drive linkage, generally indicated as 502. The motor 44 has an output shaft 504 which drives an intermediate shaft 506 by any suitable and known means. The shaft 506 has mounted there along a first one-way bearing hub and pulley combination 508 and a second one-way hub and pulley combination 510 both of any conventional construction. The shaft 83 further includes a fixed pulley 512. An endless belt 514 extends between the pulley combination 508 to the pulley 512. The shaft 216 includes a fixed pulley 516. An endless belt 518 extends between the pulley combination 510 to the pulley 516. When the motor 44 is rotated in a first direction, pulley 508 engages to drive the pulley 512 through endless belt 514 and the pulley 510 is in dwell. When the motor 44 is rotated in the second or reverse direction, pulley 510 is rotated to drive pulley 516 via endless belt 518.

Figure 6:
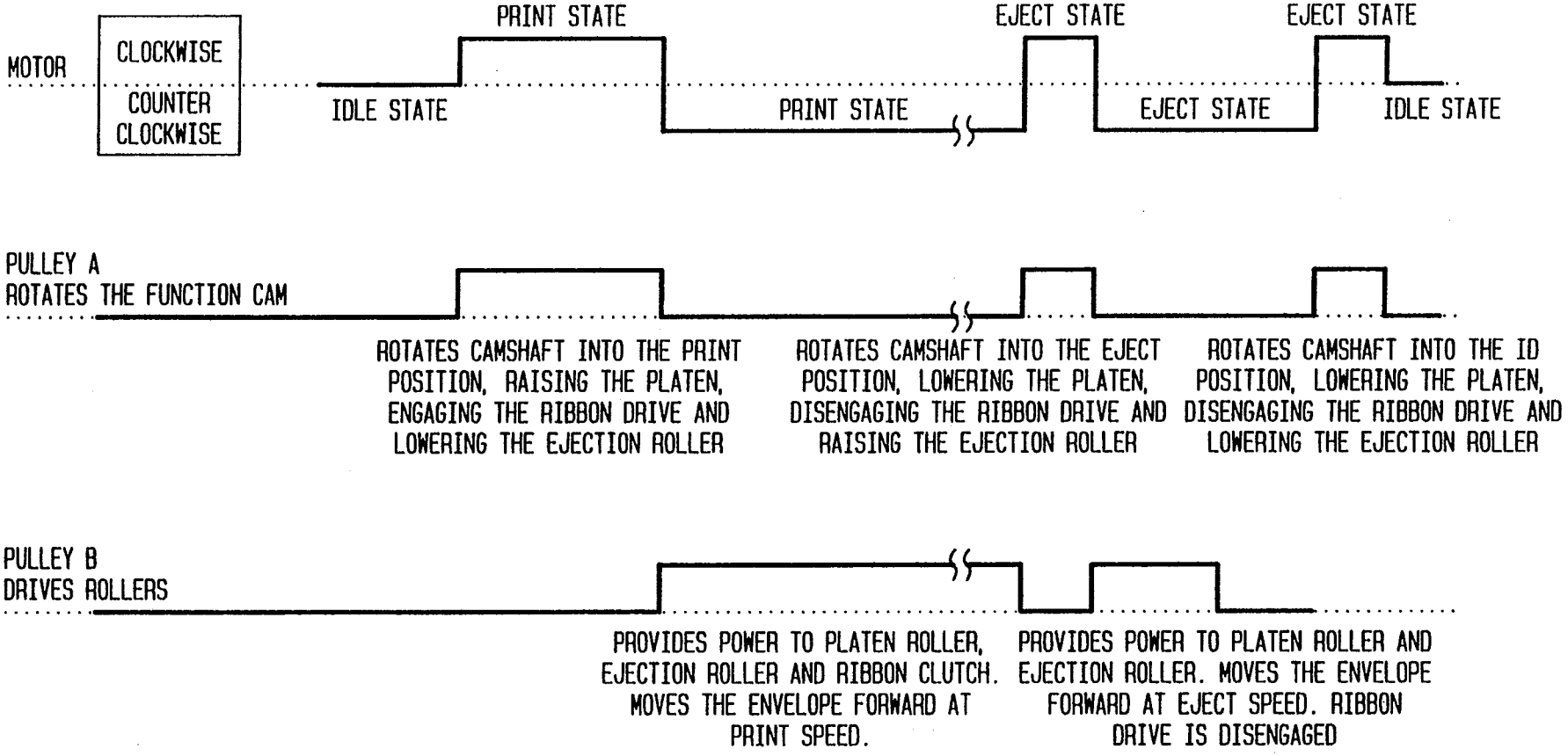
FIG. 6 is a timing diagram of the drive system in accordance with the present invention.

Also referring to FIG. 6, in operation, the motor 44 is rotated in a first direction. The clutch pulley assembly 508 is engaged to rotate pulley 512 and, hence, shaft 83. The rotation of the shaft 83 causes the eccentric rockers 209 and 530 to be rotated. The rotation of eccentric rockers 209 causes the links 201 and 214 to raise the platen 230 into the print position and lower the ejection rollers 234. The eccentric rocker 530 is rotated to act on a pivot lever 532 to pivot the lever 532 about point 534. The pivot lever 532 includes a rotatively supported shaft 536. The shaft 536 includes a gear 538 and pulley 540. The pivot action of the lever 532 brings the gear 538 into meshed engagement with the gear 327 to engage the ribbon drive.

At this time, the motor 44 is reversed to commence the print cycle in the prescribed manner as recited in U.S. patent application Ser. No. 07/950,341. Briefly, the rotation of the motor 44 in the reverse direction engages the clutched pulley 510 which through endless belt 518 causes the shaft 216 to rotate gear 246. Gear 246 is in constant mesh with gear 250 which causes rotation of the shaft 228 and in turn rotation of the platen roller 230 which has been previously raised to the print position. The shaft 216 also has fixably mounted there around a pulley 542. An endless belt 544 communicates pulley 542 with pulley 540. Therefore, the rotation of shaft 216 at this point causes the pulley 542 to rotate pulley 540 through endless belt 544. Resultantly, the shaft 536 is rotated to rotate the gear 538 which in turn causes rotation of the gear 327 and shaft 325 assuring the necessary take-up tension on the transfer ribbon.

Following completion of the print cycle, the motor 44 is now again rotated in the first direction which through shaft 83 causes the eccentric rockers 209 to lower the platen 230 and concurrently raise the ejection rollers 234. The eccentric rocker 530 is rotated to pivot to its initial position resulting in the disengagement of the gear 538 from gear 327. The motor 44 in now rotated again in the second direction to again shaft 216 through pulleys 510, 516 and belt 518. The rotation of shaft 216 drives gear 246 which is also in mesh with gear 248 to cause the ejection rolls 234 to eject the envelope. At this point the motor 44 is rotated in the first direction to bring the drive 502 in an initial position.

Figure 2:
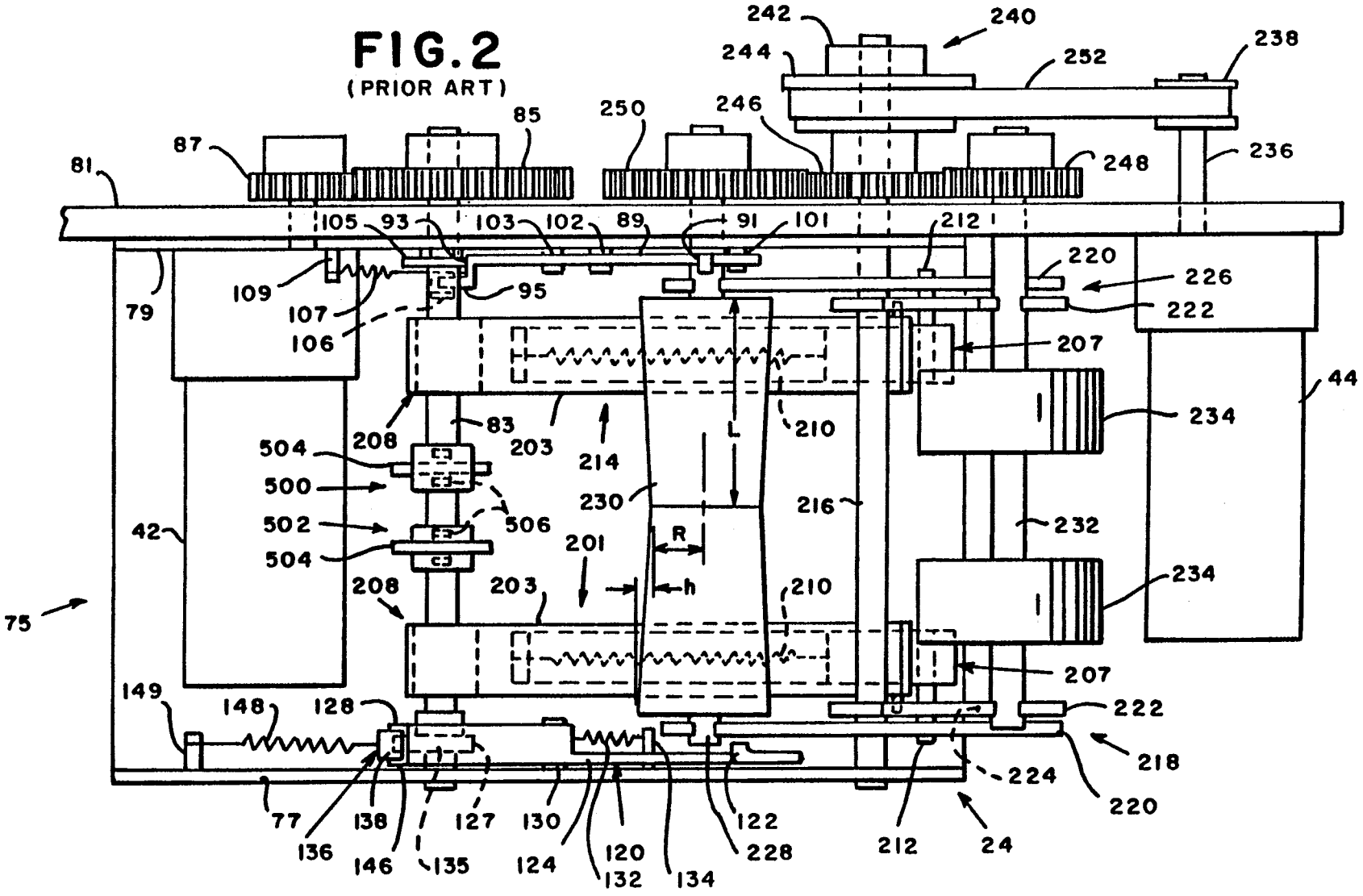
FIG. 2 (PRIOR ART)
FIG. 2 is a sectioned top view of the known thermal postage meter in accordance with the present invention.
Figure 3:
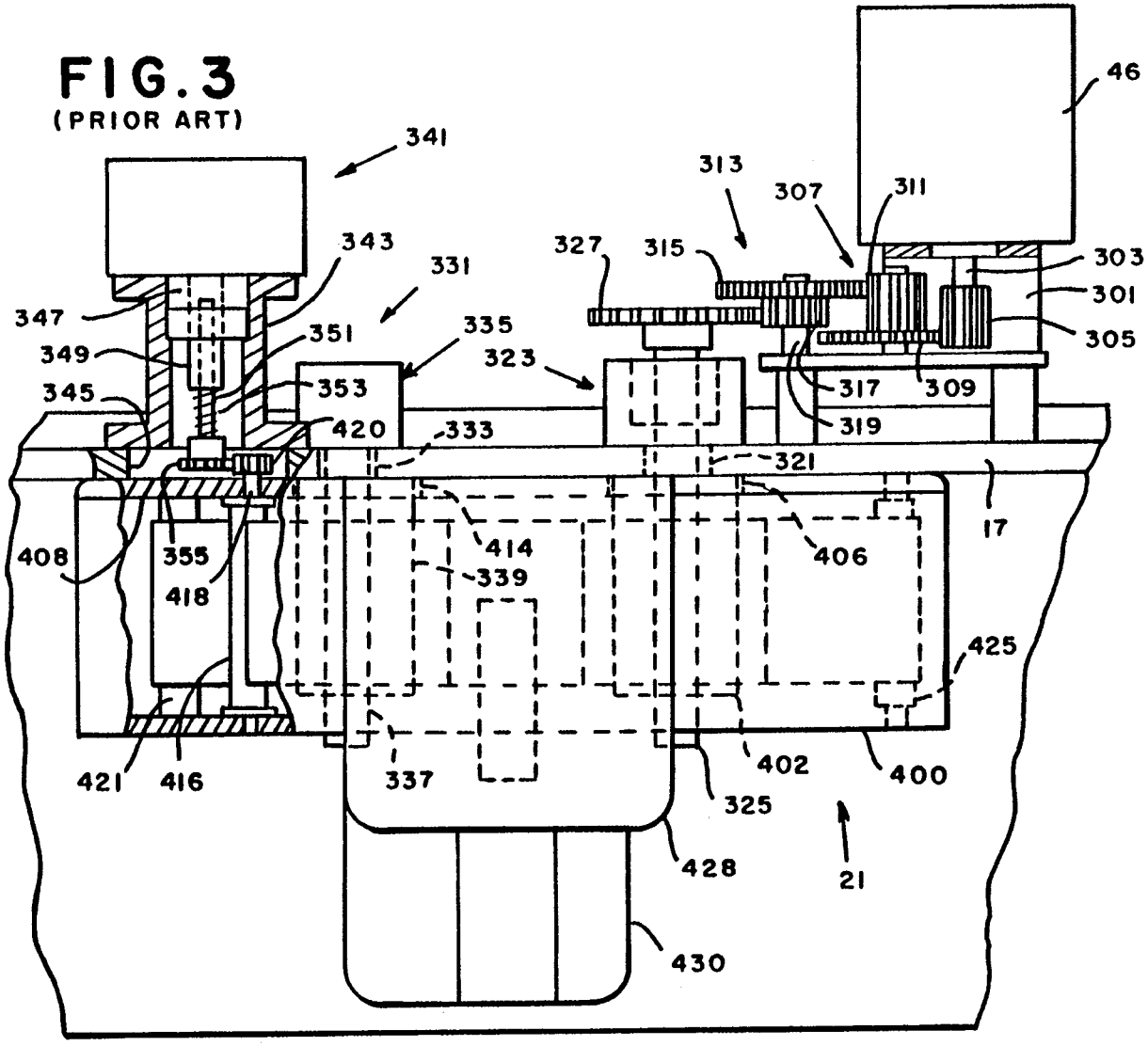
FIG. 3 (PRIOR ART)
FIG. 3 is a sectioned end view of the known thermal postage meter.

It should be appreciated by one skilled in the art that the drive system above described is intended to eliminate the use of motor 42 and 46 and associated motor drivers, and the respective gears 87, 305, 309, and 313 of the prior art device (ref. to FIGS. 1, 2 and 3). The above describes the preferred embodiment of the present invention and should not be described as limiting. The scope of the present invention is presented in the appendix claims.

What is claimed is:

1. An improved drive system in combination with a thermal printing postage meter having a base supporting a registration wall and a deck, a platen roller, an ejection roller, a micro controller, a thermal tape cassette detachably mounted to said registration and having a take-up spool and first gear means attached to the take-up spool of said thermal tape cassette, first position means for causing said platen roller to assume a print position or a non-print positions and for causing said ejection roller to assume an engaged or disengaged position, motor means in bus communication with and responsive to said micro controller, wherein said improvement comprises:

said motor means including a motor having an output shaft, said motor means being under the control of said micro controller;

linkage means in communication with said motor, said take-up spool, said first position means for sequentially (a) causing said first position mean to position said platen roller in said print position, position said ejection roller in said disengaged position and communicating with said take-up spool when said motor is rotated in a first direction by said micro controller;

(b) rotatively driving said platen and rotatively driving said take-up spool when said rotation of said motor is now driven in a reverse direction by said micro controller;

(c) causing said first position means to position said platen roller in said non-print position, position said ejection roller in said engaged position and terminating communication with said take-up spool when said motor is now rotated again is first direction by said micro controller; and, (d) rotatively driving said ejection rollers when said rotation of said motor is now again driven in said reverse direction by said micro controller.

2. An improved drive system for thermal printing postage meter as claimed in claim 1 wherein said linkage means comprises:

a second shaft in driven communication with said output shaft of said motor;

a first one-way clutch pulley fixably mounted to said second shaft providing clutch engagement with said second shaft only when said shaft is rotated in said first direction;

a third shaft in communication with said first positioning means, said third shaft having a third pulley fixably mounted thereto;

an endless belt placed around said first one-way clutch pulley and said third pulley.

3. An improved drive system for thermal printing postage meter as claimed in claim 1 wherein said linkage means comprises:

a second one-way clutch pulley fixably mounted to said second shaft providing clutch engagement with said second shaft only when said shaft is rotated in said reverse direction;

a fourth shaft means for driven said platen roller assembly and said ejection roller assembly, said fourth shaft means having a fourth shaft having a fourth pulley fixably mounted to said fourth shaft, an endless belt placed around said second one-way clutch pulley and said fourth pulley.

4. An improved drive system for thermal printing postage meter as claimed in claim 2 wherein said linkage means comprises:

a second one-way clutch pulley fixably mounted to said second shaft providing clutch engagement with said second shaft only when said shaft is rotated in said reverse direction;

a fourth shaft means for driven said platen roller assembly and said ejection roller assembly, said fourth shaft means having a fourth shaft having a fourth pulley fixably mounted to said fourth shaft, an endless belt placed around said second one-way clutch pulley and said fourth pulley.

5. An improved drive system for thermal printing postage meter as claimed in claim 4 wherein said linkage means further comprises:

said second shaft having a eccentric rocker fixably mounted thereto;

a pivot lever pivotally mounted to said base;

a fifth shaft rotatively mounted to said pivot lever having a fifth pulley and gear means fixably mounted thereto;

said pivot lever having a lever arm in contact with said eccentric rocker for pivotally positioning said pivot lever in a first position causing engagement between said gear means of said fifth shaft with said take-up spool means, said gear means of said fifth shaft for providing driving motivation to said take-up spool when engaged;

a sixth pulley fixably mounted on said third shaft, an endless belt between said fifth pulley and sixth pulley.

* * * * *